US007397323B2

(12) United States Patent
Tavassoli Hozouri

(10) Patent No.: US 7,397,323 B2
(45) Date of Patent: Jul. 8, 2008

(54) ORTHOMODE TRANSDUCER

(75) Inventor: Behzad Tavassoli Hozouri, Santa Clara, CA (US)

(73) Assignee: Wide Sky Technology, Inc., Hong Kong (CN)

( * ) Notice: Subject to any disclaimer, the term of this patent is extended or adjusted under 35 U.S.C. 154(b) by 245 days.

(21) Appl. No.: 11/457,008

(22) Filed: Jul. 12, 2006

(65) Prior Publication Data

US 2006/0226931 A1 Oct. 12, 2006

(51) Int. Cl.
*H01P 5/12* (2006.01)
*H01P 5/22* (2006.01)
*H01P 1/161* (2006.01)

(52) U.S. Cl. ..... 333/117; 333/121; 333/122; 333/126; 333/137; 333/21 A

(58) Field of Classification Search ..... 333/21 A, 333/21 R, 117, 121, 122, 124, 126, 129, 132, 333/135, 137
See application file for complete search history.

(56) References Cited

U.S. PATENT DOCUMENTS

| | | | | |
|---|---|---|---|---|
| 2,686,901 | A | 8/1954 | Dicke | |
| 3,375,472 | A | 3/1968 | Walker | |
| 3,568,190 | A * | 3/1971 | Wong | 333/117 |
| 3,670,268 | A | 6/1972 | Connerney | |
| 4,047,128 | A * | 9/1977 | Morz | 333/122 |
| 4,074,265 | A | 2/1978 | True | |
| 4,174,507 | A | 11/1979 | Young | |
| 4,413,242 | A | 11/1983 | Reeves et al. | |
| 4,504,805 | A * | 3/1985 | Ekelman et al. | 333/126 |
| 5,574,412 | A | 11/1996 | Nilsson | |
| 6,046,702 | A * | 4/2000 | Curtis et al. | 343/776 |
| 6,496,084 | B1 | 12/2002 | Monte et al. | |
| 6,504,514 | B1 | 1/2003 | Toland et al. | |
| 6,600,387 | B2 | 7/2003 | Cook et al. | |
| 6,636,127 | B2 | 10/2003 | Van Meter | |
| 6,870,512 | B2 | 3/2005 | Yoneda et al. | |

(Continued)

OTHER PUBLICATIONS

Navarrini & Plambeck, A Turnstile Junction Waveguide Orthomode Transducer, IEEE Transactions On Microwave Theory And Techniques, vol. 54, No. 1, Jan. 2006, pp. 272-277.

(Continued)

*Primary Examiner*—Robert J. Pascal
*Assistant Examiner*—Kimberly E Glenn
(74) *Attorney, Agent, or Firm*—Raymond E. Roberts; Patent Venture Group

(57) ABSTRACT

A waveguide orthomode transducer. In a first layer a turnstile junction having a main waveguide and four waveguide ports, and four hybrid tees each have an e-port, two opposed side-ports, and an h-port. The hybrid tees are ring-arranged around the turnstile junction so the waveguide ports each communicate with one h-port, so adjacent hybrid tees inter communicate with their respective side-ports, and so the e-ports form two sets of opposed e-ports. In a second layer two h-plane power dividers/combiners each have an axial-port and two opposed side-ports. The h-plane power dividers/combiners are arranged so their respective side-ports communicate with different ones of the two sets of opposed e-ports and so their axial-ports are polarization ports. This permits a single signal with two fundamental orthogonally polarized modes to enter the main waveguide and exit separated at the polarization ports vice versa.

4 Claims, 7 Drawing Sheets

U.S. PATENT DOCUMENTS

| | | | |
|---|---|---|---|
| 7,019,603 | B2 | 3/2006 | Yoneda et al. |
| 7,019,706 | B2 | 3/2006 | Yoneda et al. |
| 2004/0135657 | A1 | 7/2004 | Aramaki et al. |
| 2005/0200430 | A1 | 9/2005 | Aramaki et al. |
| 2006/0017641 | A1 | 1/2006 | Yoneda et al. |
| 2006/0097940 | A1 | 5/2006 | Shimawaki et al. |

OTHER PUBLICATIONS

Mitsubishi Electric Announces The Successful Development Of An Airborne Ku-Band Antenna Subsystem For Satellite Communications, Mitsubishi Electric Corporation, press release dated Feb. 17, 2004.

Aramaki et al., Ultra-Thin Broadband OMT with Turnstile Junction, IEEE MTT-S Digest, 2003, pp. 47-50.

Zimmerman, Jr., Robert K., Resonant Disk Turnstile, IEEE Transactions On Microwave Theory And Techniques, vol. 45, No. 9, Sep. 1997.

Meyer & Goldberg, Applications Of The Turnstile Junction, IRE Transactions—Microwave Theory And Techniques, Dec. 1955, pp. 40-45.

* cited by examiner

ORTHOMODE TRANSDUCER

TECHNICAL FIELD

The present invention relates generally to wave transmission lines and networks, and more particularly to such that include a hybrid-type network.

BACKGROUND ART

A waveguide orthomode transducer (OMT) is a radio frequency (RF) device often used to combine or separate orthogonally polarized signals, thus providing polarization-discrimination. OMTs also have important utility as polarization diplexers.

Unfortunately, most OMTs today are not fully satisfactory. For example, they may not be effective in preventing the generation of undesirable higher order modes, or they may not provide sufficiently high isolation between ports, or they may be difficult to manufacture and thus relatively expensive, or they may be unduly bulky and too thick for many important applications.

There are various types of OMTs, and one type based on a turnstile waveguide junction is of interest here because it can overcome some of the just noted shortcomings. Turnstile junction-based OMTs provide port isolation and suppress undesirable higher order modes, particularly across a broad bandwidth. OMTs of this type are therefore particularly used today to provide broadband continuous-wave (CW) duplexing of radio frequency (RF) energy, to generate elliptical polarizations, to transmit linear and receive cross-linear polarizations, to transmit and receive linear polarizations, and to transmit and receive circular polarizations. Such OMTs also may be used to measure the degree of ellipticity of circularly polarized waves, as main mode transducers in single or dual channel rotary joints, and as variable power dividers.

FIG. 1*a-b* (prior art) are depictions of a typical turnstile junction 10, as might be used in an OMT. FIG. 1*a* shows all of the wall structure 12 of the turnstile junction 10, with extensive ghost effect used to represent hidden lines. In contrast, FIG. 1*b* shows only the major structure of the turnstile junction 10, with limited use of ghost effect to represent hidden major outlines. FIG. 1*b* thus dispenses with the distracting detail of wall structure to facilitate showing important other features.

From FIG. 1*a* it can be appreciated that the turnstile junction 10 here consists, basically, of four rectangular (or ridge) waveguide ports (generically waveguide ports 14, individually waveguide ports 14*a-d*) that lie in a common plane and are placed symmetrically around and orthogonal to a longitudinal axis of a circular (or square) main waveguide 16. A matching element 18 (or matching elements, plural) may be provided at the base of the cavity formed by the waveguide ports 14 and the main waveguide 16 to enhance broadband operation of the turnstile junction 10 with a low reflection coefficient.

The structure depicted in FIG. 1*a* is merely one example, and various other shapes for the waveguide ports, the main waveguide, the cavity, and the matching elements may instead be employed in a turnstile junction. For instance, the ports can be of any transmission line type, even including planar types such as stripline.

Continuing now with FIG. 1*b*, the turnstile junction 10 exhibits two fundamental modes (generically modes 20, individually modes 20*a-b*, respectively designated Pol 1 and Pol 2 and here stylistically depicted with arrowed lines). The fundamental modes 20 can propagate in the main waveguide 16 as independent orthogonal linear polarizations, and the turnstile junction 10 splits each into equal but out-of-phase electric fields (generically e-fields 22, individually e-fields 22*a-b* of opposite polarity, and here also stylistically depicted with arrowed lines). The mode 20*a* (Pol 1) is thus split into the e-fields 22*a* and 22*b* at opposite waveguide ports 14*a* and 14*b*, but is not substantially coupled to waveguide ports 14*c* or 14*d*. Similarly, mode 20*b* (Pol 2) is split equally but out-of-phase into the e-fields 22*a* and 22*b* at waveguide ports 14*c* and 14*d*, but is not substantially coupled to waveguide ports 14*a* or 14*b*.

Since the turnstile junction 10 is a reciprocal electromagnetic device, driving any two opposite waveguide ports 14 out-of-phase and with e-fields 22*a* and 22*b* of equal power will result in transferring essentially their total power to the main waveguide 16 as one of the fundamental modes 20*a-b*, and substantially no power will enter the other, opposite waveguide ports 14.

To make an operable OMT the four waveguide ports 14 of a turnstile junction 10 need to be connected to some other device or apparatus to provide the just discussed conditions between the respective sets of opposite waveguide ports 14. One traditional approach is to attach each set of two opposite waveguide ports 14 to an E-plane T-junction or a hybrid tee junction serving as an E-plane power divider or combiner to employ the desired equally powered but out-of-phase RF signals.

FIG. 2*a-b* (prior art) are depictions of a typical hybrid tee 30 (also widely termed a "hybrid junction," "hybrid T," and "magic T" in the art). Similar to what is done in FIG. 1*b*, in FIG. 2*a-b* ghost effect is used sparingly to represent only major hidden outlines, and the distracting detail of wall structure has been dispensed with to facilitate showing more important features. The hybrid tee 30 has one H-port 32 (also sometimes called an "H-arm"), two side-ports 33 (or "side arms," or "symmetrical ports," or "symmetrical arms") and one E-port 34 (or "E-arm").

FIG. 2*a* shows the hybrid tee 30 used as an E-plane power divider/combiner 36 to combine two opposed-polarity e-fields 22*a* and 22*b* into one higher power e-field 22*c* (or to split one high power e-field 22*c* into out of phase e-fields 22*a* and 22*b* having half the power each). In the E-plane power divider/combiner 36 e-fields travel via the two opposed side-ports 33, and via the E-port 34. Conversely, FIG. 2*b* shows the hybrid tee 30 used as an H-plane power divider/combiner 38 (which has importance discussed presently) to combine two in-phase e-fields 22*b* into one e-field 22*d* (or to split one high power e-field 22*d* into two in-phase, half power e-fields 22*b*). In the H-plane power divider/combiner 38 the e-fields 22 travel via the H-port 32 and the side-ports 33, and the E-port 34 has no active role.

FIG. 3*a-c* (prior art) show three different exemplary OMTs that employ turnstile junctions. FIG. 3*a* shows FIG. 3 of NAVARRINI & PLAMBECK, "A Turnstile Junction Waveguide Orthomode Transducer," IEEE Transactions On Microwave Theory And Techniques, Vol. 54, No. 1, January 2006, pp. 272-77. FIG. 3*b* shows FIG. 1 of ARAMAKI et al., "Ultra-Thin Broadband OMT with Turnstile Junction," IEEE MTT-S Digest, 2003, pp. 47-50; and can also be seen as FIG. 1 in U.S. Pat. App. 2005/0200430 by ARAMAKI et al., titled "Waveguide Branching Filter/Polarizer" and as FIG. 5 of U.S. Pat. No. 7,019,603 by YONEDA et al. (including Yoji ARAMAKI), titled "Waveguide Type Ortho Mode Transducer" And FIG. 3c shows FIG. 1 of U.S. Pat. No. 6,600,387 by COOK et al., titled "Multi-Port Multi-Band Transceiver Interface Assembly." As can be appreciated by these three prior art examples, the transmission lines attached to the turnstile junction ports have to pass over each other to avoid interfering. The approaches of NAVARRINI & PLAMBECK and of CLARK et al. employ "normal" sized waveguides, and produce OMTs that are quite sizable. NAVARRINI & PLAMBECK teach fabricating their device from four machined bocks that are bolted together, thus being especially challenging to manufacture economically. The patent by CLARK et al. is specialized, resorts to waveguide pass-overs to fully utilize a turnstile junction, but can be manufactured with more conventional techniques. The approach of ARAMAKI et al. reduces the waveguide heights and uses pass-overs to minimize the total thickness. However, this excessive reduction of waveguide height compromises power handling capability, and the passing over itself increases thickness of the overall device.

In summary turnstile junction-based OMTs generally remain bulky and thick, or else require accepting undesirable performance compromises. And accordingly, what is still needed is an OMT design that provides the advantages of the turnstile junction yet permits the resulting OMT to be small and thin, yet to have high power handling capability, provides low VSWR, to provide high mode purity over a broad bandwidth, to exhibit high isolation between ports, and that is easy to manufacture.

DISCLOSURE OF INVENTION

Accordingly, it is an object of the present invention to provide an improved waveguide orthomode transducer.

Briefly, one preferred embodiment of the present invention is a waveguide orthomode transducer. A turnstile junction and four hybrid tees are provided in a first layer. The turnstile junction has a main waveguide and four waveguide ports, and the hybrid tees each respectively have an e-port, two opposed side-ports, and an h-port. The hybrid tees are ring-arranged around said turnstile junction so that the waveguide ports each communicate with an h-port of one of the hybrid tees, so that adjacent of the hybrid tees communicate with each other via their respective side-ports, and so that the e-ports of the hybrid tees form two sets of opposed e-ports. Two h-plane power dividers/combiners are provided in a second layer. The h-plane power dividers/combiners each respectively have an axial-port and two opposed side-ports. The h-plane power dividers/combiners are each arranged so their respective side-ports communicate with different ones of the two sets of opposed e-ports and so the axial-ports of the h-plane power dividers/combiners are polarization ports. This permits a single radio frequency signal including two fundamental orthogonally polarized modes to enter the transducer at the main waveguide and exit the transducer separated at the polarization ports, or it permits two radio frequency signals each including a different fundamental orthogonally polarized mode to enter the transducer at a respective polarization port and exit the transducer combined at the main waveguide.

An advantage of the present invention is that it provides an inherently compact and thin waveguide orthomode transducer (OMT).

Another advantage of the invention is that the OMT may be embodied to have high power handling capability, or may be embodied to trade power handling capability for additional compactness and thickness reduction.

Another advantage of the invention is that the resulting OMT has high mode purity over a broad bandwidth, provides low VSWR, and exhibits high isolation between ports.

And another advantage of the invention is that the OMT is easy to manufacture.

These and other objects and advantages of the present invention will become clear to those skilled in the art in view of the description of the best presently known mode of carrying out the invention and the industrial applicability of the preferred embodiment as described herein and as illustrated in the figures of the drawings.

BRIEF DESCRIPTION OF THE DRAWINGS

The purposes and advantages of the present invention will be apparent from the following detailed description in conjunction with the appended figures of drawings in which:

FIG. 1*a-b* (prior art) depict a typical turnstile junction, as might be used in an OMT, wherein FIG. 1*a* shows all of the wall structure with extensive ghost effect representing hidden lines and FIG. 1*b* shows only the major structure with ghost effect representing only major hidden outlines.

FIG. 2*a-b* (prior art) are depictions of a typical hybrid tee, wherein FIG. 2*a* shows the hybrid tee used as an E-plane power divider/combiner and FIG. 2*b* shows the hybrid tee used as an H-plane power divider/combiner.

FIG. 4*a-c* are top plan views of an OMT in accord with the present invention, wherein FIG. 4*a* shows how the elements in two layers of the OMT interoperate, FIG. 4*b* shows the OMT with its upper, second layer removed and FIG. 4*c* shows the OMT with its lower, first layer removed.

In the various figures of the drawings, like references are used to denote like or similar elements or steps.

BEST MODE FOR CARRYING OUT THE INVENTION

Figure 1A:
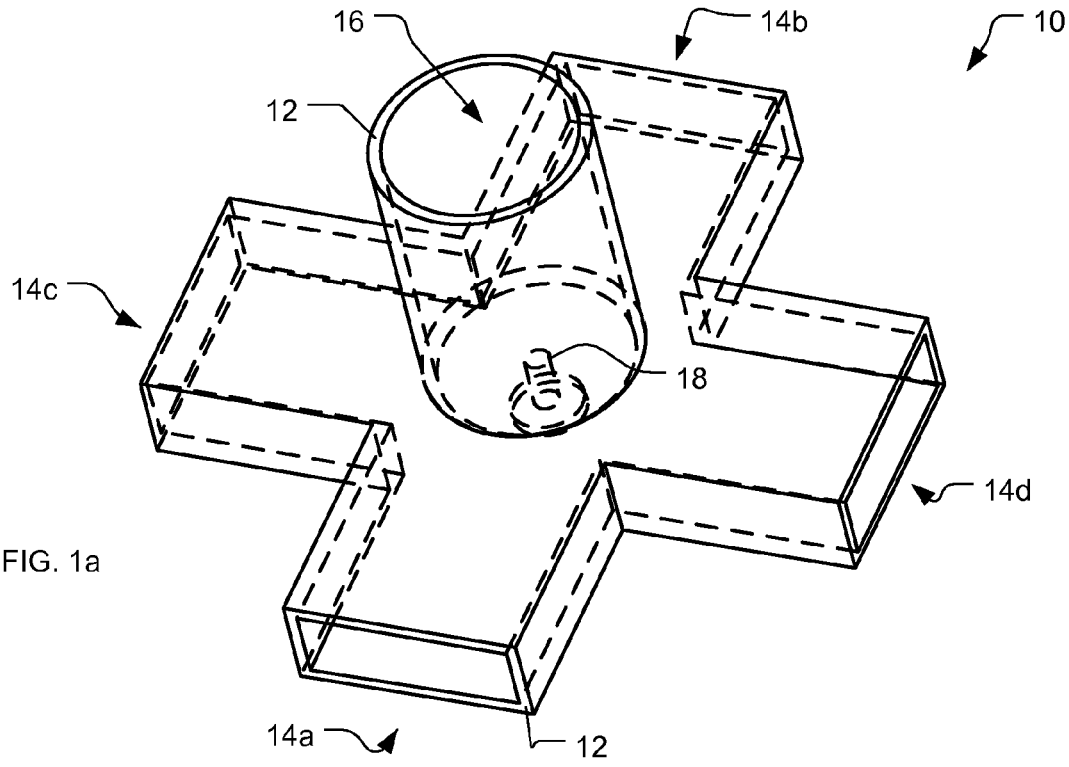
Figure 1B:
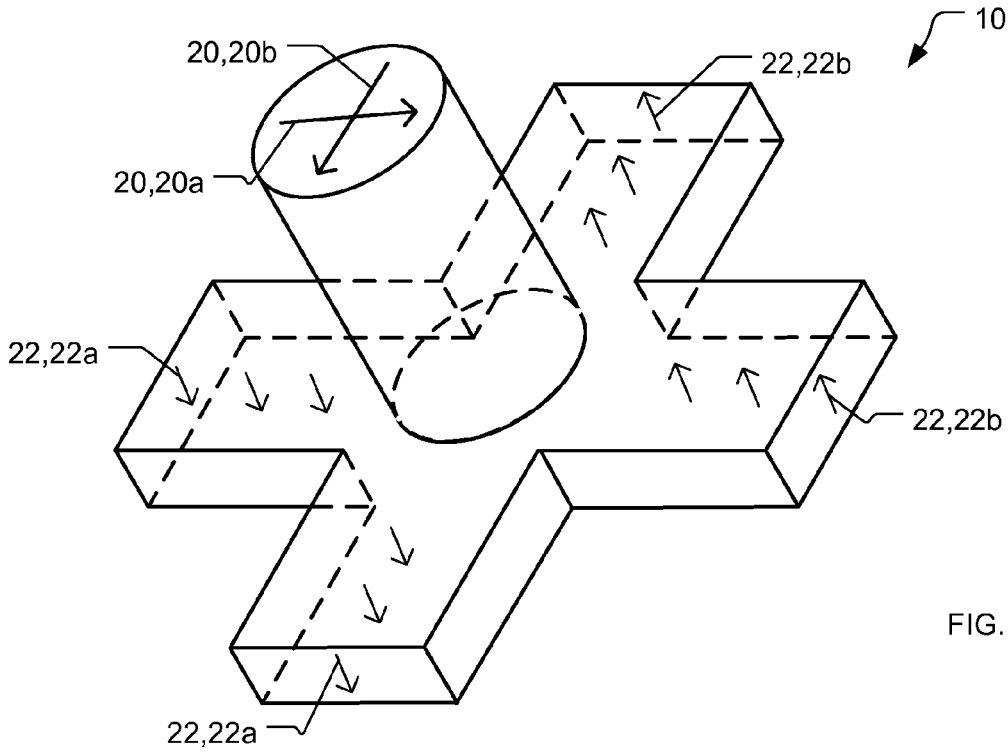
Figure 2A:
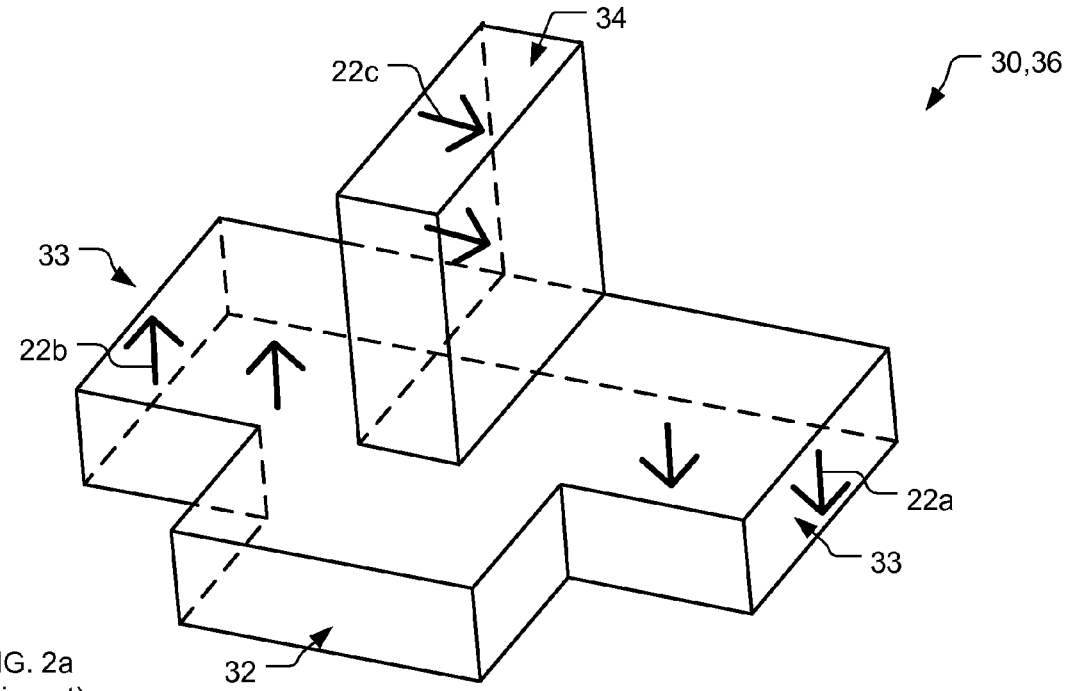
FIG. 2a (prior art)
Figure 2B:
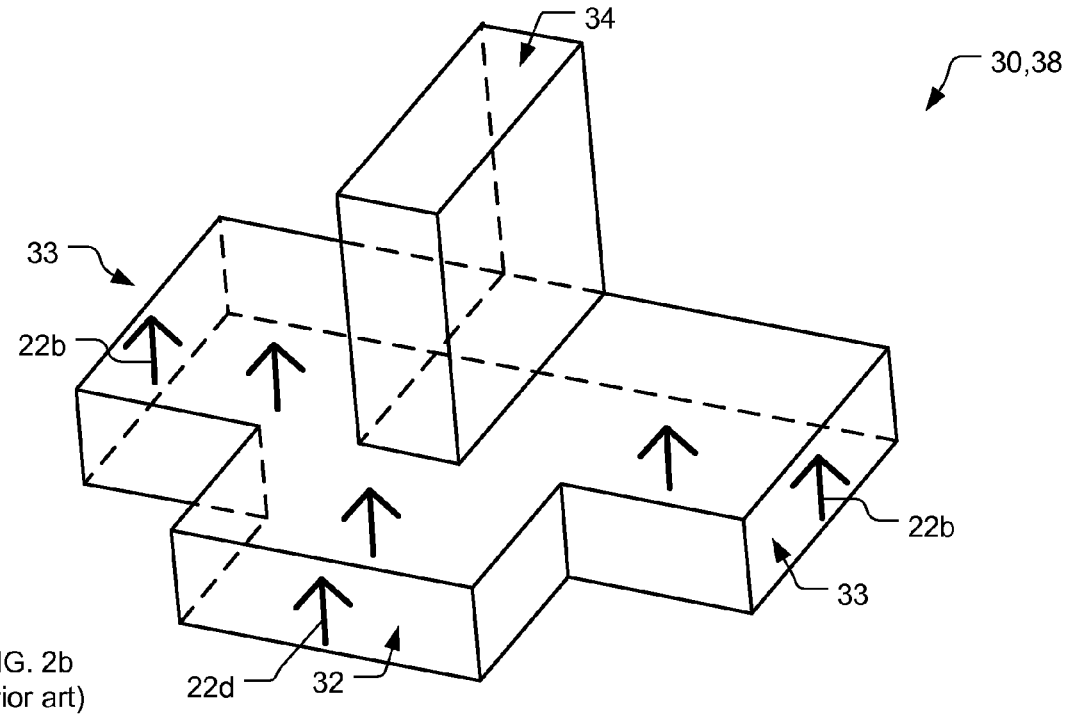
FIG. 2b (prior art)
Figure 3A:
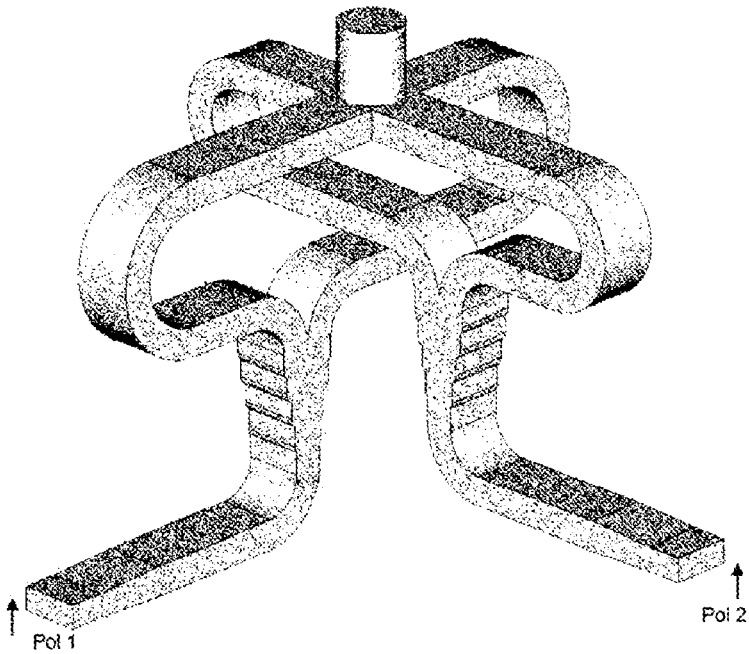
FIG. 3a (prior art)
FIG. 3*a-c* (prior art) show three different exemplary OMTs that employ turnstile junctions.
Figure 3B:
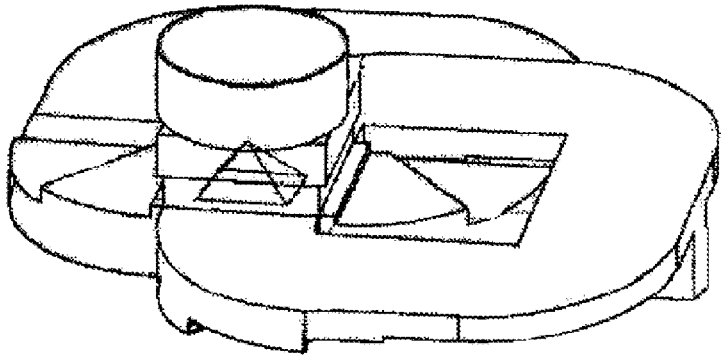
FIG. 3b (prior art)
Figure 3C:
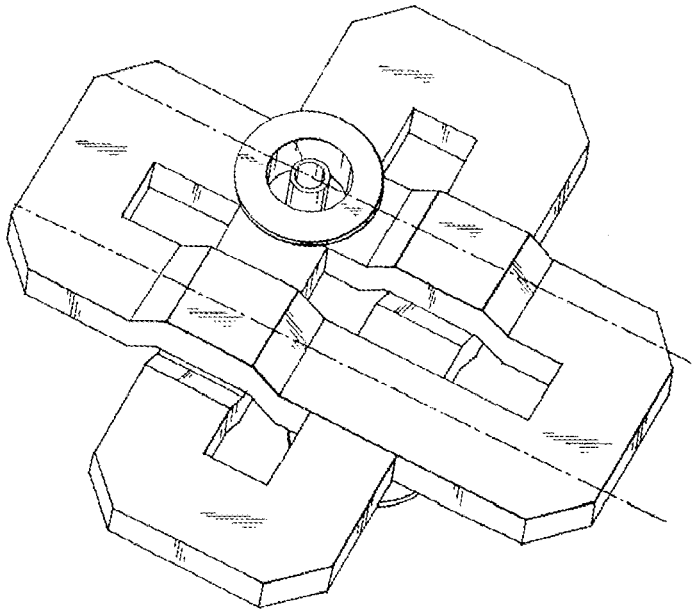
FIG. 3c (prior art)

A preferred embodiment of the present invention is a waveguide orthomode transducer (OMT). As illustrated in the various drawings herein, and particularly in the view of FIG. 4*a*, preferred embodiments of the invention are depicted by the general reference character 100.

Briefly, the inventive OMT combines connecting waveguides as needed, a turnstile junction, and four hybrid tees functioning as both H-plane and E-plane power dividers/combiners on a first layer, and connecting waveguides as needed and two H-plane T-junctions or hybrid tees with terminated E-ports functioning as H-plane power dividers/combiners on a second layer. A waveguide port is provided on the first layer and two polarization ports are provided on and oriented coplanar with the second layer, thus making the OMT notably compact. Furthermore, since there is no interference issue for the elements to avoid, they can be optimally dimensioned, and thus allow the OMT to achieve close to theoretical maximum performance. From a symmetry point of view, only the opposing sets of hybrid tees in the first layer need to be similar. There is no need for all four of the hybrid-tees in the first layer to be similar. Also, the two H-plane power dividers/combiners in the second layer can be different and, if implemented as hybrid tees, they need not be similar to those in the first layer.

Figure 4A:
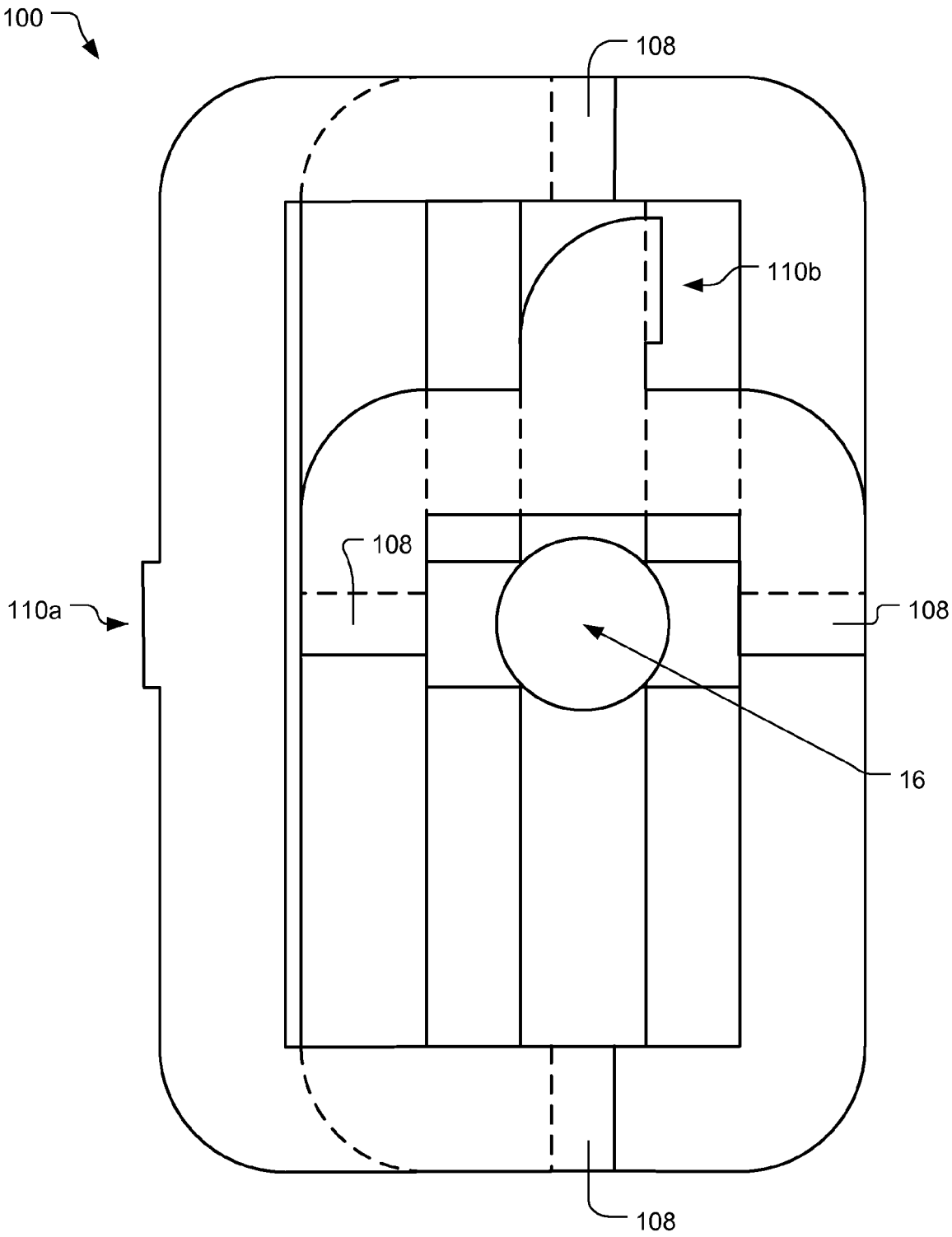
Figure 4B:
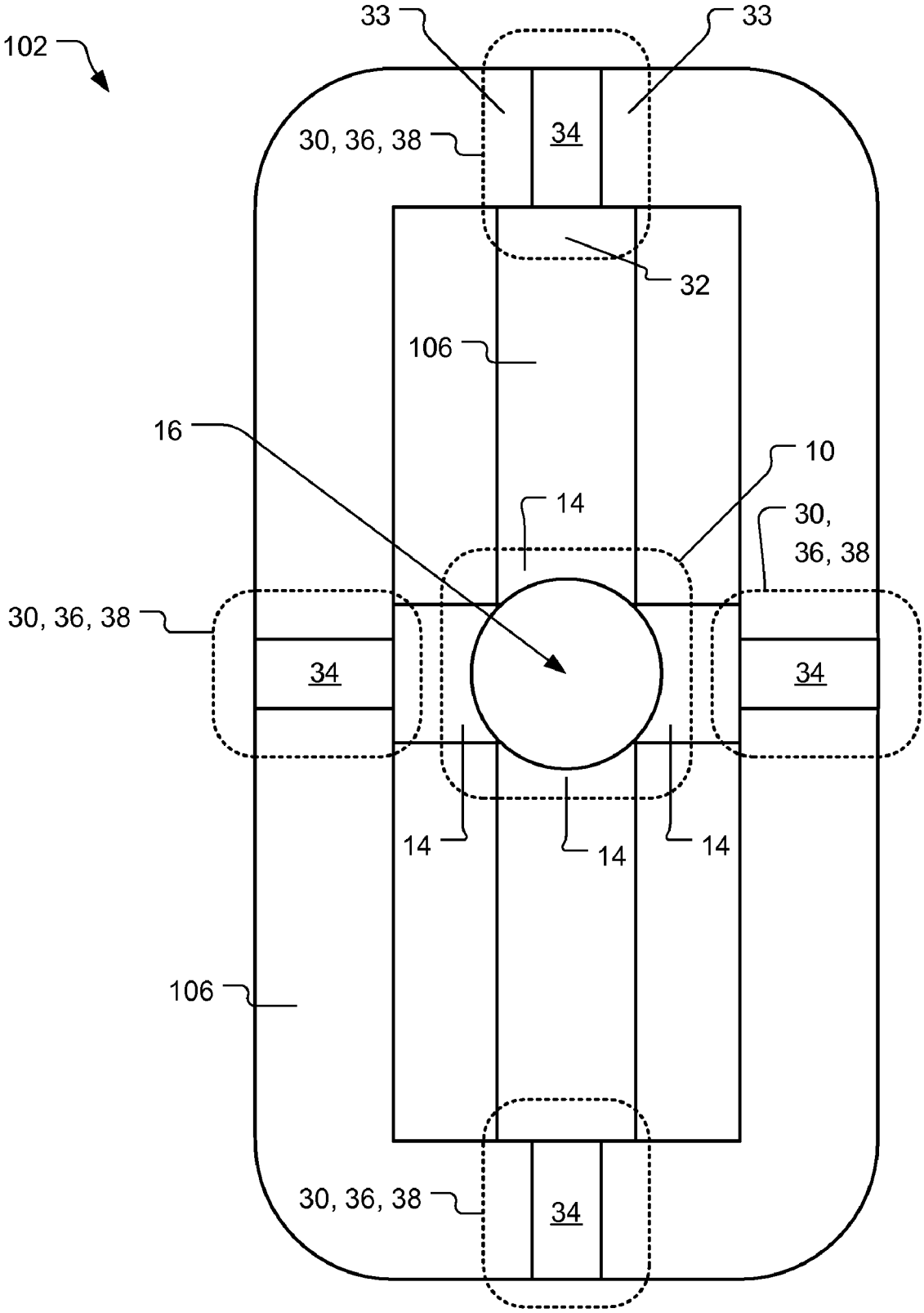

FIG. 4*a* is a top plan view of an OMT 100 in accord with the present invention that shows how the elements in two layers interoperate. FIG. 4*b* is top plan view of the OMT 100 with its upper, second layer 104 removed (i.e., showing only the elements of a lower first layer 102), and FIG. 4*c* is top plan view of the OMT 100 with its lower, first layer 102 removed (i.e., showing only the elements of the upper second layer 104).

Turning now just to FIG. 4*b*, it can be seen here that in the first layer 102 the OMT 100 includes a turnstile junction 10, four hybrid tees 30 (functioning here both as E-plane power dividers/combiners 36 and H-plane power dividers/combiners 38) and connecting waveguides 106. The turnstile junction 10 can be essentially conventional and has a main waveguide 16 (here extending upward from the page) and four waveguide ports 14. Similarly, the hybrid tees 30 can be essentially conventional and each respectively has one H-port 32, two side-ports 33, and one E-port 34 (with the E-ports 34 here all also extending upward from the page). The connecting waveguides 106 connect the turnstile junction 10 and the hybrid tees 30 as shown.

Figure 4C:
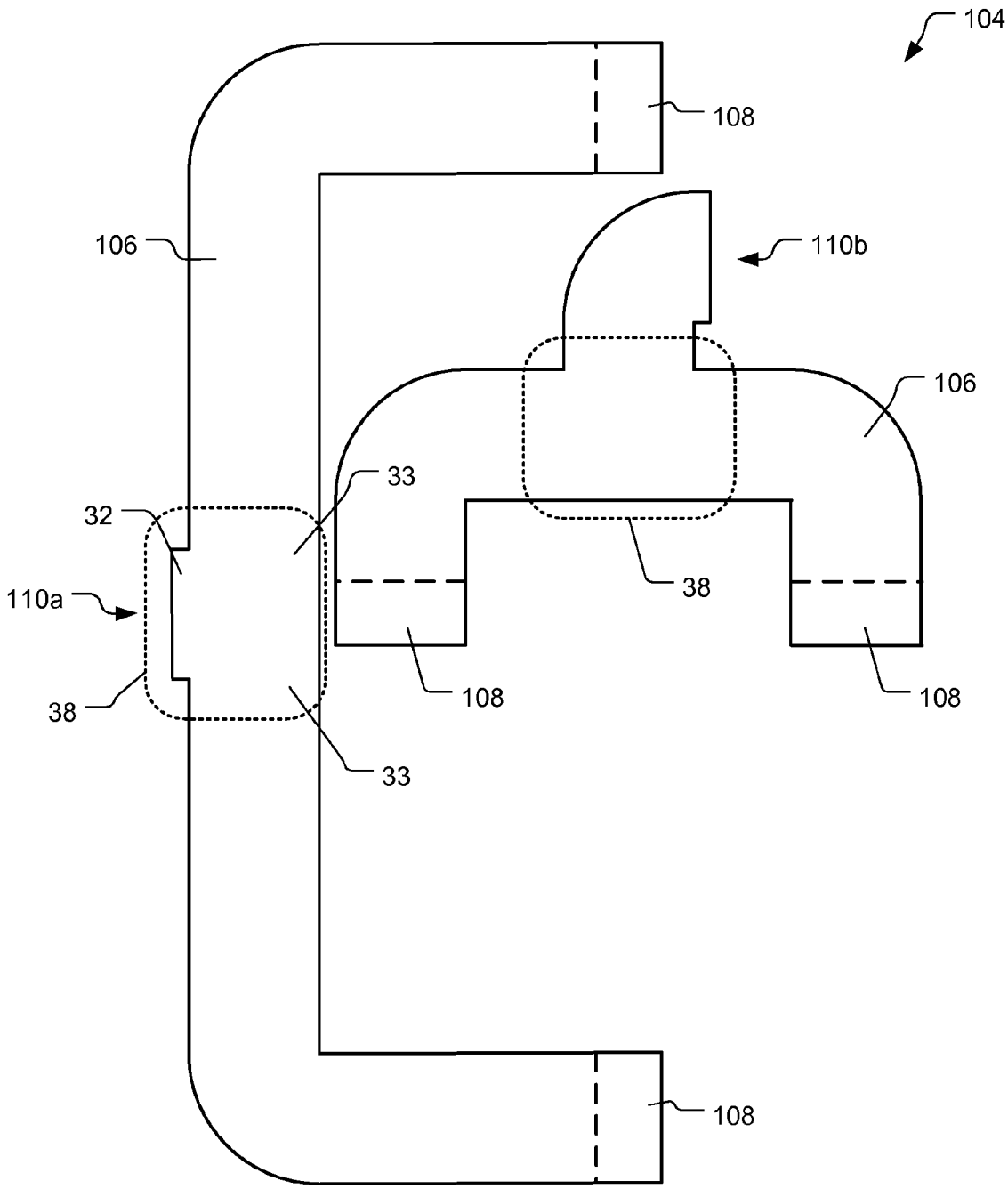

Turning now just to FIG. 4*c*, it can be seen that in the second layer 104 the OMT 100 includes four connection points 108, two H-plane power dividers/combiners 38, two polarization ports 110*a-b*, and also more connecting waveguides 106. The H-plane power dividers/combiners 38 here can also be essentially conventional. For instance they can be H-plane T-junctions (with an axial-port and two side ports), or they can be hybrid tees 30 each respectively having one H-port 32, two side-ports 33, and one E-port 34 that is terminated and that does not communicate with elements in the first layer 102. The connecting waveguides 106 here connect the connection points 108, the H-plane power dividers/combiners 38, and the polarization ports 110*a-b* as shown.

Figure 5A:
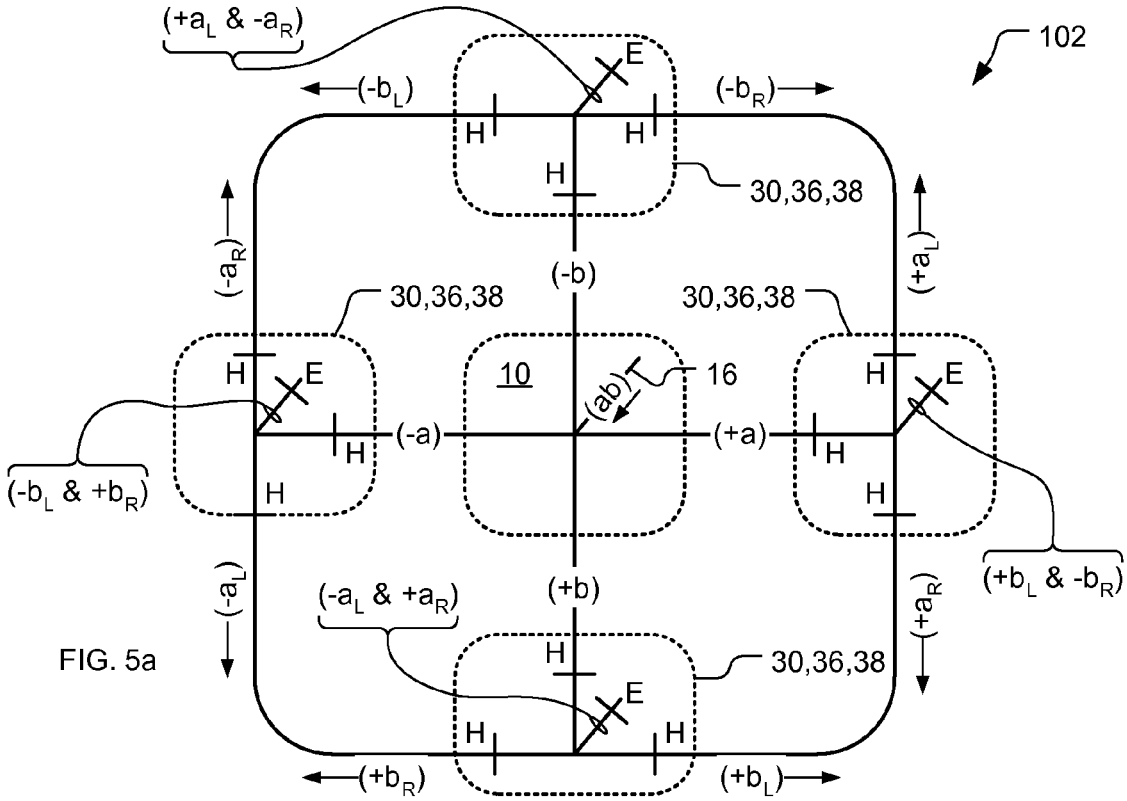
FIG. 5*a-b* are line diagrams depicting the RF wave in the two layers of the OMT of FIG. 4*a-c*.
Figure 5B:
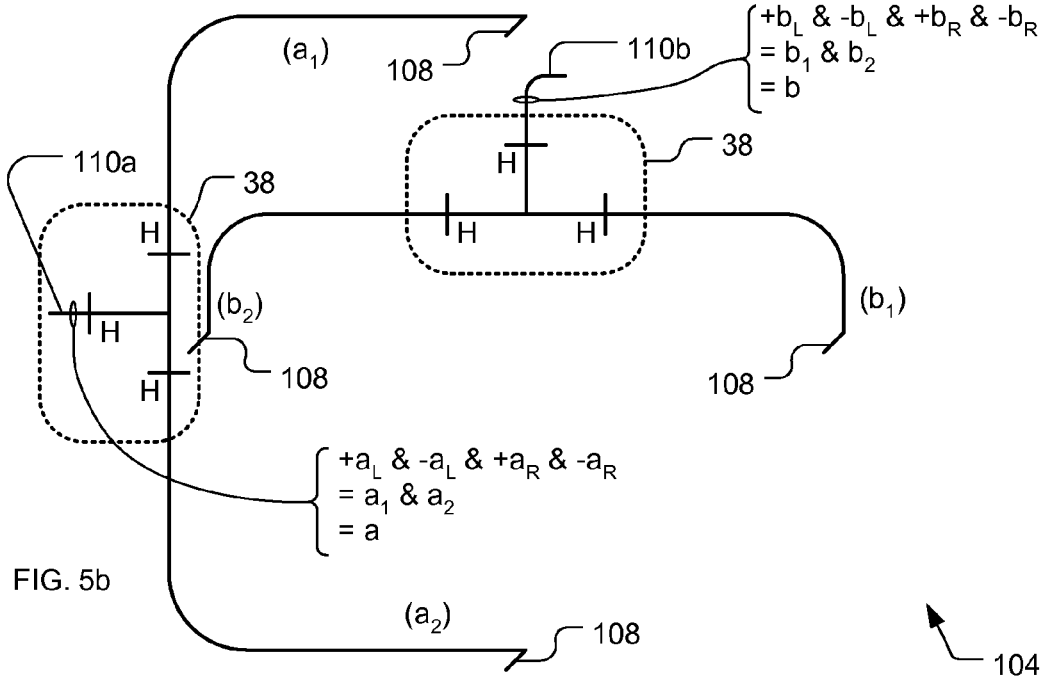

And turning to FIG. 4*a* as well as FIG. 4*b-c*, it can now be appreciated that the connection points 108 connect with the hybrid tees 30 in the first layer 102. FIG. 5*a-b* are line diagrams that omit most of the structure for clarity, to depict the RF wave in the two layers 102, 104 of the inventive OMT 100 and to illustrate RF wave travel for an example based on use of OMT 100 is used as a mode separator.

When a signal with two fundamental orthogonally polarized modes is fed into the main waveguide, the modes ("a" and "b" for the sake of this example) are distributed by the turnstile junction as polarized electric fields (+a, −a, +b, and −b) to the respective waveguide ports.

The respective hybrid tees 30 then function here first as H-plane power dividers, each separating a polarized electric field into left and right portions (defined from the perspective of one looking from the turnstile junction 10 outward). Thus, for instance, the rightmost hybrid tee 30 is used as an H-plane power divider/combiner 38 to split one electric field (+a) into both a left portion ($+a_L$) and a right portion ($+a_R$) as shown.

The hybrid tees 30 next function here as E-plane power combiners, to deliver combined sets of the portions to the second layer 104. So again considering the rightmost hybrid tee 30, it now is used as an E-plane power divider/combiner 36 to combine a positive left portion of a field ($+b_L$) and a negative right portion of a field ($-b_R$) into a pirst part of the b-mode ($b_1$) as shown.

In the second layer 104, the H-plane power dividers/combiners 38 there receive these sets ($a_1$, $a_2$, $b_1$, $b_2$) and, functioning here as combiners, combine them as shown. For instance, the leftmost H-plane power divider/combiner 38 outputs a signal that has all of the parts ($a_1$ & $a_2$; i.e., all of the portions $+a_L$ & $-a_L$ & $+a_R$ & $-a_R$) for the a-mode.

Stated alternately, an initial signal (ab) including an a-mode and a b-mode is separated into a first signal (a) including the a-mode and a second signal (b) including the b-mode. In pseudo code, the goal is ab==>a & b, and it is achieved by:

$$a \Rightarrow +a \,\&\, -a; \quad b \Rightarrow +b + \,\&\, -b;$$

$$+a \Rightarrow +aL \,\&\, +aR; \quad -a \Rightarrow -aL \,\&\, -aR;$$

-continued $$+b \Rightarrow +bL \,\&\, +bR; \quad -b \Rightarrow -bL \,\&\, -bR;$$

$$+aL \,\&\, -aR \Rightarrow a1; \quad -aL \,\&\, +aR \Rightarrow a2;$$

$$+bL \,\&\, -bR \Rightarrow b1; \quad -bL \,\&\, +bR \Rightarrow b2;$$

$$a1 \,\&\, a2 \Rightarrow a; \quad \text{and } b1 \,\&\, b2 \Rightarrow b.$$

Of course, the inventive OMT 100 can instead be used to combine a first signal (a) including an a-mode and a second signal (b) including a b-mode into one signal (ab). In pseudo code, the goal here is a & b==>ab, and it is achieved by:

$$a \Rightarrow a1 \,\&\, a2; \quad b \Rightarrow b1 \,\&\, b2;$$

$$a1 \Rightarrow +aL \,\&\, -aR; \quad a2 \Rightarrow -aL \,\&\, +aR;$$

$$b1 \Rightarrow +bL \,\&\, -bR; \quad b2 \Rightarrow -bL \,\&\, +bR;$$

$$+aL \,\&\, +aR \Rightarrow +a; \quad -aL \,\&\, -aR \Rightarrow -a;$$

$$+bL \,\&\, +bR \Rightarrow +b; \quad -bL \,\&\, -bR \Rightarrow -b; \text{ and}$$

$$+a \,\&\, -a \,\&\, +b \,\&\, -b \Rightarrow ab.$$

From FIG. 4*a-c* and FIG. 5*a-b* it can now be understood how the total power of any one fundamental mode 20 entering the inventive OMT 100 (e.g., mode 20*a*; one of two possible orthogonal polarizations) via the main waveguide 16 is split substantially equally and with the same phase between two opposite E-ports 34 in the first layer 102. Then, using one of the H-plane power dividers/combiners 38 in the second layer 104, that power can then be combined and transferred to a single respective one of the polarization ports 110*a-b*. And for the other fundamental mode 20*b*, a similar process applies. It should be noted that the two H-plane power dividers/combiners 38 here can be implemented as coplanar devices without blocking each other. Accordingly, for the inventive OMT 100 there are only two layers that need to be fabricated.

Turning now to a SATCOM Ku-band application-based example, using properly designed devices such as the turnstile junction and the hybrid tees, a total thickness of about 16 mm can be achieved for the combined layers. This is notably less than the 20 mm thickness achieved by prior art devices (without making serious performance compromises). And for low power applications, which permit using waveguides with reduced height, the total thickness of embodiments of the present inventive OMT 100 can be further reduced, e.g., down to about 10 mm for the same Ku-band application.

In an application where combined lesser thickness and reduced planar extension (i.e., footprint) is sought, a 3-layer embodiment of the inventive OMT 100 may be employed. For instance, one where one of the power dividers/combiners, particularly the bigger one, is implemented on the 3rd layer can be used to make it as small as the other one. Thus, the transmission lines (e.g., the connecting waveguides 106 in the figures herein) in all of the layers can be optimally dimensioned without any concern about their crossing. It follows that the inventive OMT 100 can be embodied in various shapes and to utilize different types of turnstile junctions, hybrid tees and power dividers/combiners, intermediate waveguides/transmission lines, bends, etc. Even other intermediate connecting devices, like waveguide tapers, can be used in place of the connecting waveguides 106.

While the invention has been described in conjunction with specific embodiments thereof, many alternatives, modifications and variations will be apparent to those of ordinary skill in the art in light of the foregoing description. Accordingly, the invention is intended to embrace all such alternatives, modifications and variations as fall within the broad scope of the appended claims.

What is claimed is:

1. A waveguide orthomode transducer, comprising: in a first layer: a turnstile junction having a main waveguide and four waveguide ports; four hybrid tees each respectively having an e-port, two opposed side-ports, and an h-port; and wherein said hybrid tees are ring-arranged around said turnstile junction such that said waveguide ports each communicate with said h-port of one said hybrid tee, such that adjacent said hybrid tees communicate with each other via their respective said side-ports, and such that said e-ports of said hybrid tees form two sets of opposed e-ports; in a second layer: two h-plane power dividers/combiners each respectively having an axial-port and two opposed side-ports; and wherein said h-plane power dividers/combiners are each arranged such that their respective said side-ports communicate with different ones of said two sets of opposed e-ports and such that said axial-ports of said h-plane power dividers/combiners are polarization ports, thereby permitting a single radio frequency signal including two orthogonally polarized modes to enter the transducer at said main waveguide and exit the transducer separated at said polarization ports or permitting two radio frequency signals each including a different orthogonally polarized mode to enter the transducer at a respective said polarization port and exit the transducer combined at said main waveguide.

2. The transducer of claim 1, wherein said h-plane power dividers/combiners are hybrid tees each having an h-port that is a said axial-port and having an e-port that is terminated.

3. A method for separating a radio frequency initial signal including an a-mode and a b-mode that are orthogonally polarized into a first signal including the a-mode and a second signal including the b-mode, the method comprising:

separating the a-mode into a positive polarity a-mode electric field and a negative polarity a-mode electric field;

separating the b-mode into a positive polarity b-mode electric field and a negative polarity b-mode electric field;

separating said positive polarity a-mode electric field into a positive a-mode left-portion and a positive a-mode right-portion;

separating said negative polarity a-mode electric field into a negative a-mode left-portion and a negative a-mode right-portion;

separating said positive polarity b-mode electric field into a positive b-mode left-portion and a positive b-mode right-portion;

separating said negative b-mode polarity electric field into a negative b-mode left-portion and a negative b-mode right-portion;

combining said positive a-mode left-portion and said negative a-mode right-portion into an a-mode first part;

combining said negative a-mode left-portion and said positive a-mode right-portion into an a-mode second part;

combining said positive b-mode left-portion and said negative b-mode right-portion into a b-mode first part;

combining said negative b-mode left-portion and said positive b-mode right-portion into a b-mode second part;

combining said a-mode first part and said a-mode second part into the first signal including the a-mode; and combining said b-mode first part and said b-mode second part into the second signal including the b-mode.

4. A method for combining a first radio frequency signal including an a-mode and a second radio frequency signal including a b-mode, wherein the a-mode and the b-mode are orthogonally polarized, into a third radio frequency signal including both the a-mode and the b-mode, the method comprising:

separating the a-mode into an a-mode first part and an a-mode second part;

separating the b-mode into a b-mode first part and a b-mode second part;

separating said a-mode first part into a positive a-mode left-portion and a negative a-mode right-portion;

separating said a-mode second part into a negative a-mode left-portion and a positive a-mode right-portion;

separating said b-mode first part into a positive b-mode left-portion and a negative b-mode right-portion;

separating said b-mode second part into a negative b-mode left-portion and a positive b-mode right-portion;

combining said positive a-mode left-portion and said positive a-mode right-portion into a positive polarity a-mode electric field;

combining said negative a-mode left-portion and said negative a-mode right-portion into a negative polarity a-mode electric field;

combining said positive b-mode left-portion and said positive b-mode right-portion into a positive polarity b-mode electric field;

combining said negative b-mode left-portion and said negative b-mode right-portion into a negative polarity b-mode electric field; and combining said positive polarity a-mode electric field, said negative polarity a-mode electric field, said positive polarity b-mode electric field, and said negative polarity b-mode electric field into the third radio frequency signal.

* * * * *